US005616972A

United States Patent [19]

Weiser

[11] Patent Number: 5,616,972

[45] Date of Patent: Apr. 1, 1997

[54] SWITCHING ARRANGEMENT WITH SWITCHING CONTACTS AND AN INDUCTIVE LOAD

[75] Inventor: Josef Weiser, Hohenschäftlarn, Germany

[73] Assignee: Siemens Aktiengesellschaft, Munich, Germany

[21] Appl. No.: 416,726

[22] PCT Filed: Oct. 1, 1993

[86] PCT No.: PCT/DE93/00925

§ 371 Date: Apr. 7, 1995

§ 102(e) Date: Apr. 7, 1995

[87] PCT Pub. No.: WO94/09502

PCT Pub. Date: Apr. 28, 1994

[30] Foreign Application Priority Data

Oct. 9, 1992 [DE] Germany ..... 42 34 122.1

[51] Int. Cl.[6] ..... H01H 9/30

[52] U.S. Cl. ..... 307/137; 200/51.12; 218/74; 218/123; 361/12

[58] Field of Search ..... 307/137; 361/142, 361/12; 200/51.12; 218/123, 74

[56] References Cited

U.S. PATENT DOCUMENTS

| | | | |
|---|---|---|---|
| 3,621,275 | 11/1971 | Santi | 307/137 |
| 3,697,774 | 10/1972 | Pascente | 361/13 |
| 4,348,566 | 9/1982 | Baba et al. | 218/123 |
| 5,072,328 | 12/1991 | Dvorak et al. | 361/210 |
| 5,285,035 | 2/1994 | Williams et al. | 200/80 |

*Primary Examiner*—William M. Shoop, Jr.
*Assistant Examiner*—Albert W. Paladini
*Attorney, Agent, or Firm*—Hill, Steadman & Simpson

[57] ABSTRACT

In the case of a circuit arrangement with switching contacts made from silver or a silver alloy for the purpose of switching an inductive load, for example a motor, in a direct-current circuit, the arcing time is adjusted as a function of the breaking current by appropriate design of the ratio of inductance and ohmic resistance in accordance with the prescribed relationship. It is possible as a result to prevent or at least minimize the material migration between the anode and cathode of the pair of switching contacts.

8 Claims, 1 Drawing Sheet

SWITCHING ARRANGEMENT WITH SWITCHING CONTACTS AND AN INDUCTIVE LOAD

BACKGROUND OF THE INVENTION

The invention relates to a circuit arrangement with a pair of switching contacts made from silver and/or a silver alloy and with an inductive load which can be connected to a DC voltage source via the pair of switching contacts.

Inductive loads in DC circuits occur, for example, in automobiles where ever more DC motors are being used owing to the increase in comfort and safety. In particular, in safety systems, for example the anti-skid system, there is a need for a long lifetime in operating cycles, but also for a high switching reliability, that is to say a low failure rate, in the range of use of the switching device, specifically the relay or switch. Both criteria, lifetime and failure rate, are strongly influenced by the material migration of the contacts during switching operation under load in the case of direct current. Of importance in this case is the formation of tips and holes on the contacts which, from the statistical point of view, are highly likely to lead to premature mechanical sticking of the contacts.

The phenomenon of material migration has been known for a long time. It has already been proposed several times to keep this effect as slight as possible by selecting specific alloys and specific pairs of contacts. Such silver alloys are described, for example, in EP 0 448 757 A1. However, in the case of selecting the contact materials purely from the point of view of material migration there is the risk that other contact properties cannot be selected optimally.

Another known possibility of avoiding material migration consists in employing circuit technology to intercept the arc by means of spark-quenching elements. However, such a supplementary circuit is costly.

SUMMARY OF THE INVENTION

The object of the invention is to employ circuit engineering in the case of a circuit arrangement with switching contacts, made from silver or a silver alloy, and an inductive load so as to avoid material migration in the simplest possible way without the contact material having to be specially selected and without the need for expensive additional circuit elements in the load circuit.

According to the invention, this object is achieved when the arcing time of the breakdown arc is determined by the circuit-specific time constant T from the ratio of the inductance L and the ohmic resistance R in the load circuit as a function of the predetermined design breaking current i according to the following relationship:

$$T|\mu s| = \frac{L}{R} = (10 \pm 5)\left|\frac{\mu s}{A}\right| \cdot i|A| \qquad \text{(TB1)}$$

for $1\ A \leqq i \leqq 20\ A$

Additional features and advantages of the present invention are described in, and will be apparent from, the detailed description of the presently preferred embodiments and from the drawings.

and $$200|\mu s| < T|\mu s| = \frac{L}{R} \leqq 10|ms| \qquad \text{(TB2)}$$

-continued for $20\ A \leqq i \leqq 30\ A$.

Thus, the invention provides for the range, which is most interest in practice, of the specific, expected breaking current from 1 to 30 A a design rule for the load circuit, specifically for the ratio of the inductance to the ohmic resistance, and thus for the arcing time, by means of which the material migration can be completely suppressed or at least greatly reduced. The invention makes use in this regard of the following finding:

The material migration is the result of asymmetric evaporation processes on the two contacts, specifically the anode and the cathode. These are essentially produced by the breakdown arc, in particular in the case of inductive loads. It is the arcing time of this breakdown arc which is decisive in this regard. In certain regions of the arcing time, the asymmetry of the evaporation process can be compensated owing to special physical effects in such a way that the material migration virtually vanishes in the final analysis, that is to say no tips and holes are produced on the contact surfaces. Such a relatively flat surface profile of the contacts decisively reduces the risk of mechanical sticking, lengthens the lifetime and increases the operating reliability of the contacts.

Since the arcing time of the breakdown arc is essentially given by the time constant, that is to say the cut-off inductance L of the inductive component, for example a motor, and the ohmic resistance R thereof, it is possible according to the invention, for example, to select the motors in the load circuit in such a way that the breakdown arc assumes the arcing time defined in accordance with the invention.

Additional features and advantages of the present invention are described in, and will be apparent from, the detailed description of the presently preferred embodiments and from the drawings.

BRIEF DESCRIPTION OF THE DRAWINGS

The invention is explained in more detail below using an exemplary embodiment with the aid of a drawing, in which.

DETAILED DESCRIPTION OF THE PRESENTLY PREFERRED EMBODIMENTS

Figure 1:
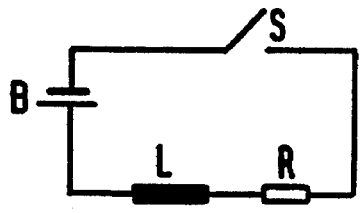
FIG. 1 shows a simple circuit diagram of a circuit with an inductive load.

FIG. 1 shows a simplified circuit diagram of a load circuit with a direct-current source B, a switching contact S and an inductive load which is represented by the series connection of an inductor L and an ohmic resistor R. This load is preferably a DC motor as used, for example, in automobiles for driving various functional units.

Figure 2:
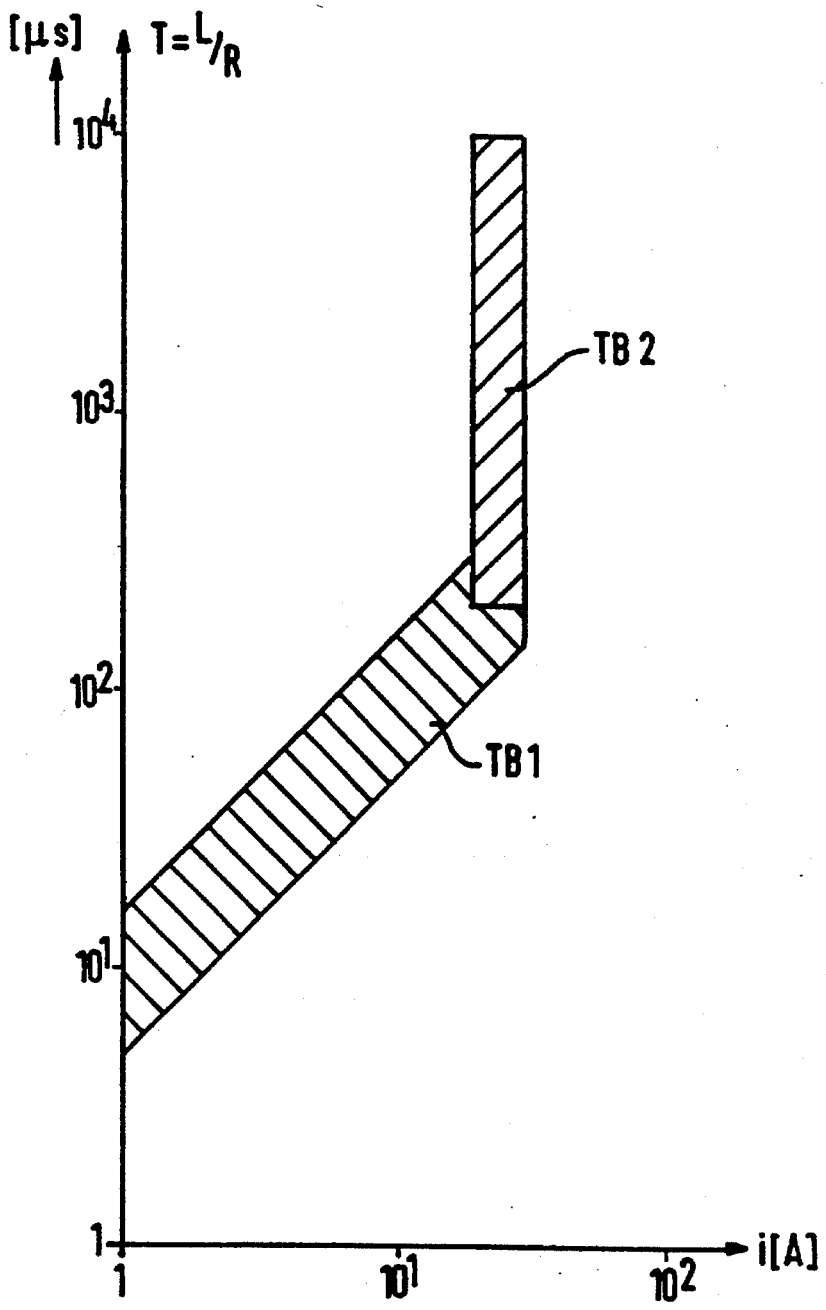
FIG. 2 shows a graph for the region, prescribed in accordance with the invention, of the time constant for the breakdown arc as a function of the breaking current.

FIG. 2 shows, plotted on a logarithmic scale against the breaking current i, the time constant T as the ratio of inductance L and ohmic resistance R, which determines the arcing time. In this case, the regions provided according to the invention for determining the time constant T are drawn in hatched in each case, specifically in the region TB1 for breaking currents from 1 A to approximately 20 A and the region TB2 for breaking currents between 20 A and 30 A. The regions each have a specific band width, it being assumed in principle that in the case of relatively weak breaking currents the time constant should be situated more at the lower boundary of the respective region, and in the case of relatively strong breaking currents the time constant should be situated more at the upper boundary of the region. The exact values for optimum exclusion of the material migration can be determined in the individual case for the contact materials employed by means of simple tests.

In the case of combinations of breaking currents and arcing times which are situated in FIG. 2 to the left of and above the two optimum regions TB1 and TB2, the material migration produces an anode gain, and in the case of combinations to the right of and below these optimum regions, the material migration leads to a cathode gain.

The maximum upper limit of the arcing time of the arc should not exceed 10 ms in the region TB2, since in the case of switching devices of conventional design, that is to say in the case of relays and switches, from the statistical point of view the arc is no longer reliably quenched above this arcing time given an open contact.

In this case, there is the risk that the contact system can be thermally destroyed in a short time in the case of a single operating cycle. In the case of an additional electrical wiring of the switched load with the aim of partial spark quenching, or in the case of wiring the drive coil of the switching device in order to protect the drive electronics (resistor, diode, etc.), it is, of course, the value which is currently produced and in this case, of course, depends on the load parameters (L, R) and the diverse wiring parameters, which is valid for the time constant. This can be detected using measurement techniques and be included in an optimized fashion in the stated favorable regions according to the invention. It is therefore not necessary in this case to quench the arc, something which could be relatively difficult and expensive; instead, optimization with respect to its arcing time is sufficient.

Although other modifications and changes may be suggested by those skilled in the art, it is the intention of the inventors to embody within the patent warranted hereon all changes and modifications as reasonably and properly come within the scope of their contribution to the art.

The time constant (T) is fixed and invariable for selected values of L and R.

I claim:

1. A circuit arrangement with a pair of switching contacts, and with an inductive load connected to a DC voltage source via the pair of switching contacts, wherein an arcing time of a breakdown arc between said contacts is determined by a time constant (T) from the ratio of the inductance (L) and the ohmic resistance (R) in the load circuit as a function of the breaking current (i) according to the following relationship:

$$T|\mu s| = \frac{L}{R} = (10 \pm 5)\left|\frac{\mu s}{A}\right| \cdot i|A|$$

for $1\ A \leqq i \leqq 20\ A$

-continued and $$200|\mu s| < T|\mu s| = \frac{L}{R} \leqq 10|ms|$$

for $20\ A \leqq i \leqq 30\ A$.

2. The circuit according to claim 1 wherein said contacts are made of silver.

3. The circuit according to claim 1 wherein said contacts are made of a silver alloy.

4. A circuit comprising:

a pair of switching contacts which are connectable and disconnectable, a breakdown arc having a breaking current (i) occurring between said contacts upon disconnection thereof;

an inductive load having a time constant (T), an inductance (L) and an ohmic resistance (R); and a DC voltage source which is connectable across said load via said switching contacts;

wherein:

$$T|\mu s| = \frac{L}{R} = (10 \pm 5)\left|\frac{\mu s}{A}\right| \cdot i|A|$$

for $1\ A \leqq i \leqq 20\ A$ and $$200|\mu s| < T|\mu s| = \frac{L}{R} \leqq 10|ms|$$

for $20\ A \leqq i \leqq 30\ A$.

5. The circuit according to claim 4 wherein said contacts are made of silver.

6. The circuit according to claim 4 wherein said contacts are made of a silver alloy.

7. The circuit according to claim 4 wherein said inductive load is a motor.

8. A method of making a circuit having a pair of contacts which connect an inductive load to a DC source, the inductive load having a time constant (T), an inductance (L) and a resistance (R), said contacts having a breaking current (i), the method comprising the step of:

selecting the inductive load such that:

$$T|\mu s| = \frac{L}{R} = (10 \pm 5)\left|\frac{\mu s}{A}\right| \cdot i|A|$$

for $1\ A \leqq i \leqq 20\ A$ and $$200|\mu s| < T|\mu s| = \frac{L}{R} \leqq 10|ms|$$

for $20\ A \leqq i \leqq 30\ A$.

* * * * *